US011651886B2

(12) United States Patent
Kazuta et al.

(10) Patent No.: US 11,651,886 B2
(45) Date of Patent: May 16, 2023

(54) MULTILAYER COIL COMPONENT

(71) Applicant: TDK CORPORATION, Tokyo (JP)

(72) Inventors: Youichi Kazuta, Tokyo (JP); Kazuya Tobita, Tokyo (JP); Yuto Shiga, Tokyo (JP); Noriaki Hamachi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 664 days.

(21) Appl. No.: 16/721,078

(22) Filed: Dec. 19, 2019

(65) Prior Publication Data

US 2020/0203051 A1 Jun. 25, 2020

(30) Foreign Application Priority Data

Dec. 20, 2018 (JP) ..... JP2018-238661

(51) Int. Cl.
*H01F 17/00* (2006.01)
*H01F 27/32* (2006.01)
*H01F 27/29* (2006.01)

(52) U.S. Cl.
CPC ..... *H01F 17/0013* (2013.01); *H01F 27/292* (2013.01); *H01F 27/32* (2013.01)

(58) Field of Classification Search
CPC ..... H01F 17/0013; H01F 27/292; H01F 27/32
See application file for complete search history.

(56) References Cited

U.S. PATENT DOCUMENTS 6,580,350 B1 * 6/2003 Kobayashi ..... H01F 17/0013 336/200
2004/0232556 A1 11/2004 Pitts et al.
2008/0286933 A1 11/2008 Pitts et al.
2009/0256668 A1 * 10/2009 Noma ..... H01F 17/0013 336/200
2011/0133880 A1 6/2011 Pitts et al.
2013/0257576 A1 * 10/2013 Arata ..... H01F 17/0013 336/200
2016/0078997 A1 * 3/2016 Son ..... H01F 17/0013 174/260
2016/0141102 A1 * 5/2016 Tseng ..... H01F 27/292 336/200
2017/0103848 A1 * 4/2017 Yoneda ..... H01F 17/0013
2019/0051450 A1 * 2/2019 Shimoda ..... H01F 27/30

FOREIGN PATENT DOCUMENTS

JP 07192921 A * 7/1995
JP H07-192921 A 7/1995
JP H09-162354 A 6/1997
JP 2004095860 A * 3/2004
JP 2004-349703 A 12/2004
JP 2012204475 A * 10/2012
JP 2018-050022 A 3/2018
JP 2018050022 A * 3/2018 ..... H01F 17/0013

* cited by examiner

*Primary Examiner* — Mang Tin Bik Lian
*Assistant Examiner* — Malcolm Barnes
(74) *Attorney, Agent, or Firm* — Oliff PLC

(57) ABSTRACT

A multilayer coil component 1 includes an element 2 having a plurality of stacked insulator layers 6 and a coil 8 disposed in the element 2. The coil 8 has a plurality of coil conductors and a connection conductor interconnecting one of the coil conductors and another of the coil conductors. A plurality of the connection conductors are spaced apart only in a direction intersecting with an extension direction of the coil conductors at a position of the connection by the connection conductor.

5 Claims, 4 Drawing Sheets

MULTILAYER COIL COMPONENT

TECHNICAL FIELD

An aspect of the present invention relates to a multilayer coil component.

BACKGROUND

A multilayer coil component including an element having a plurality of stacked insulator layers and a coil disposed in the element is known (see, for example, Japanese Unexamined Patent Publication No. H7-192921 and Japanese Unexamined Patent Publication No. 2018-50022). The coil has a plurality of coil conductors and a connection conductor interconnecting the coil conductors that are adjacent to each other.

SUMMARY

In the multilayer coil component according to the related art, a plurality of the connection conductors are disposed along the extension direction of the coil conductor. When a current flows through the coil conductor in this configuration, the current is concentrated on one connection conductor disposed on the upstream side of the current flow. In particular, the current is concentrated on the surface of the connection conductor due to a skin effect as the frequency of an alternating current increases, and then it becomes difficult for the current to flow through the region that is inside the connection conductor. As a result, in the multilayer coil component, an increase in resistance arises in the connection conductor and the current flow becomes difficult. Accordingly, desired characteristics may not be obtained and degradation of characteristics may arise in the multilayer coil component according to the related art.

An object of an aspect of the present invention is to provide a multilayer coil component capable of suppressing degradation of characteristics.

A multilayer coil component according to an aspect of the present invention includes an element having a plurality of stacked insulator layers and a coil disposed in the element. The coil has a plurality of coil conductors and a connection conductor interconnecting one of the coil conductors and another of the coil conductors. A plurality of the connection conductors are spaced apart only in a direction intersecting with an extension direction of the coil conductors at a position of the connection by the connection conductor when viewed from a direction in which the plurality of insulator layers are stacked.

In the multilayer coil component according to an aspect of the present invention, the plurality of connection conductors are spaced apart only in the direction intersecting with the extension direction of the coil conductors at the position of the connection by the connection conductor. In other words, the plurality of connection conductors are spaced apart in a direction that is not along the extension direction of the coil conductors. As a result, when a current flows through the coil in the multilayer coil component, the current flows evenly (in a distributed manner) with respect to the plurality of connection conductors. Accordingly, in the multilayer coil component, it is possible to avoid resistance becoming high and the current flow becoming difficult due to current concentration on one connection conductor. Therefore, degradation of characteristics can be suppressed in the multilayer coil component.

In one embodiment, each of the plurality of connection conductors may have a shape along the coil conductor when viewed from the direction in which the plurality of insulator layers are stacked. In this configuration, the surface area of the connection conductor can be ensured. Accordingly, an increase in the resistance of the connection conductor can be suppressed, even in the case of current concentration on the surface of the connection conductor attributable to a skin effect, since the surface area is large.

In one embodiment, lengths of respective outer peripheries of the plurality of connection conductors may be equivalent when viewed from the direction in which the plurality of insulator layers are stacked. In this configuration, the current that flows through each connection conductor can be made even more uniform. Accordingly, it is possible to more appropriately avoid resistance becoming high and the current flow becoming difficult due to current concentration on one connection conductor.

In one embodiment, an irregularity may be fawned at least in part on respective outer peripheries of the plurality of connection conductors when viewed from the direction in which the plurality of insulator layers are stacked. In this configuration, the surface area of the connection conductor can be increased. As a result, in the multilayer coil component, the surface area of the connection conductor through which a current is capable of flowing in the skin effect is increased, and thus an increase in the resistance of the connection conductor can be further suppressed.

In one embodiment, a projecting portion of the irregularity of the other of a pair of the connection conductors may be disposed in a recessed portion of the irregularity of one of the pair of connection conductors in the pair of connection conductors disposed so as to face each other when viewed from the direction in which the plurality of insulator layers are stacked. In this configuration, the contact area between the coil conductor and the connection conductor can be ensured (to the maximum). Accordingly, a current is capable of easily flowing through the coil in the multilayer coil component.

According to an aspect of the present invention, degradation of characteristics can be suppressed.

DETAILED DESCRIPTION

Figure 1:
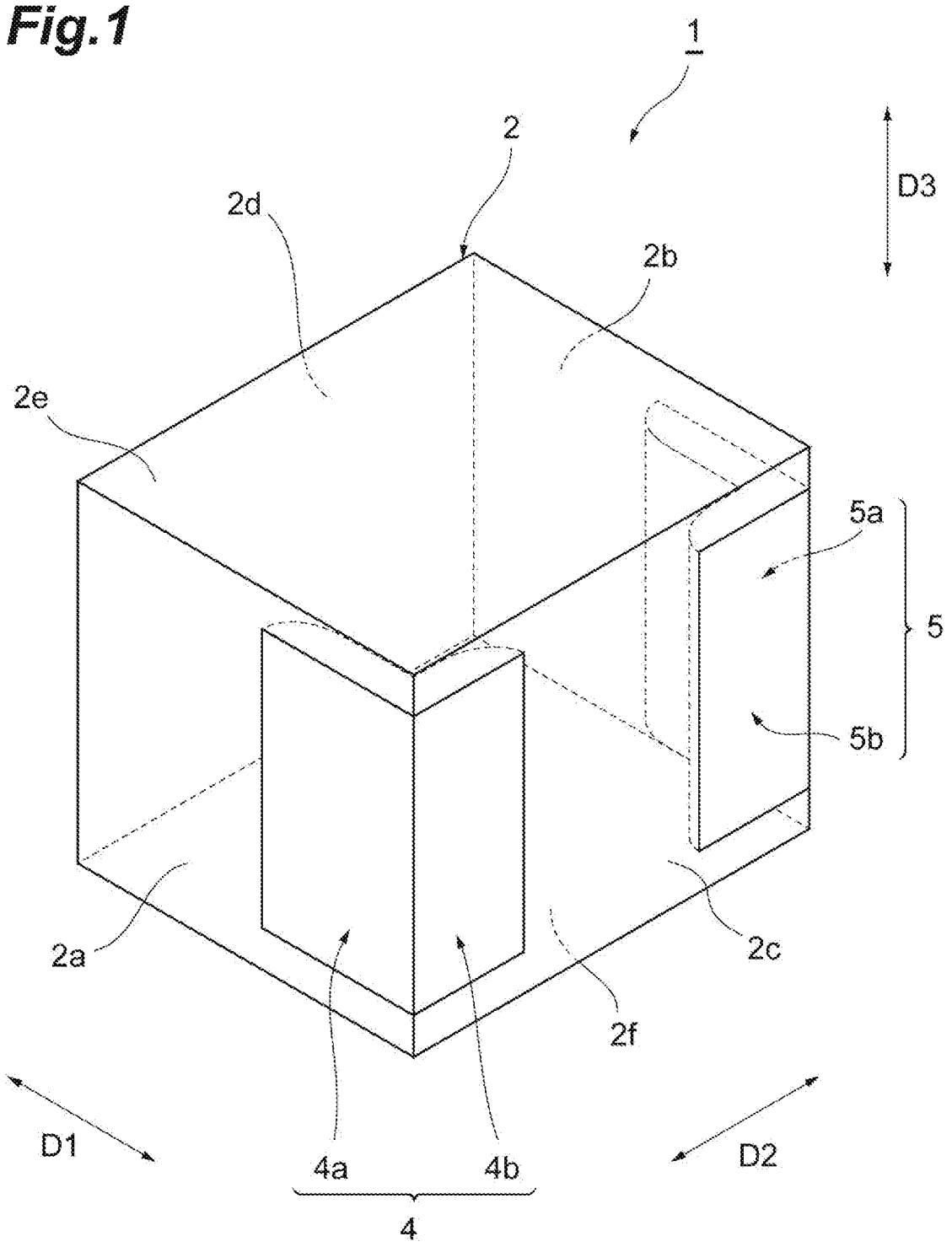
FIG. 1 is a perspective view illustrating a multilayer coil component according to an embodiment.

Hereinafter, a preferred embodiment of the present invention will be described in detail with reference to the accompanying drawings. In the description of the drawings, the same or corresponding elements will be denoted by the same reference numerals and redundant description will be omitted.

As illustrated in FIG. 1, a multilayer coil component 1 is provided with an element 2 having a rectangular parallelepiped shape and a pair of terminal electrodes 4 and 5. The pair of terminal electrodes 4 and 5 are respectively disposed in both end portions of the element 2. The rectangular parallelepiped shape includes a rectangular parallelepiped shape in which corner and ridge line portions are chamfered and a rectangular parallelepiped shape in which corner and ridge line portions are rounded.

The element 2 has a pair of end surfaces 2*a* and 2*b* facing each other, a pair of main surfaces 2*c* and 2*d* facing each other, and a pair of side surfaces 2*e* and 2*f* facing each other. The direction in which the pair of main surfaces 2*c* and 2*d* face each other, that is, the direction that is parallel to the end surfaces 2*a* and 2*b* is a first direction D1. The direction in which the pair of end surfaces 2*a* and 2*b* face each other, that is, the direction that is parallel to the main surfaces 2*c* and 2*d* is a second direction D2. The direction in which the pair of side surfaces 2*e* and 2*f* face each other is a third direction D3. In the present embodiment, the first direction D1 is the height direction of the element 2. The second direction D2 is the longitudinal direction of the element 2 and is orthogonal to the first direction D1. The third direction D3 is the width direction of the element 2 and is orthogonal to the first direction D1 and the second direction D2.

The pair of end surfaces 2*a* and 2*b* extend in the first direction D1 so as to interconnect the pair of main surfaces 2*c* and 2*d*. The pair of end surfaces 2*a* and 2*b* also extend in the third direction D3, that is, the short side direction of the pair of main surfaces 2*c* and 2*d*. The pair of side surfaces 2*e* and 2*f* extend in the first direction D1 so as to interconnect the pair of main surfaces 2*c* and 2*d*. The pair of side surfaces 2*e* and 2*f* also extend in the second direction D2, that is, the long side direction of the pair of end surfaces 2*a* and 2*b*. The multilayer coil component 1 is, for example, solder-mounted onto an electronic device (such as a circuit board or an electronic component). In the multilayer coil component 1, the main surface 2*d* constitutes a mounting surface facing the electronic device.

Figure 2:
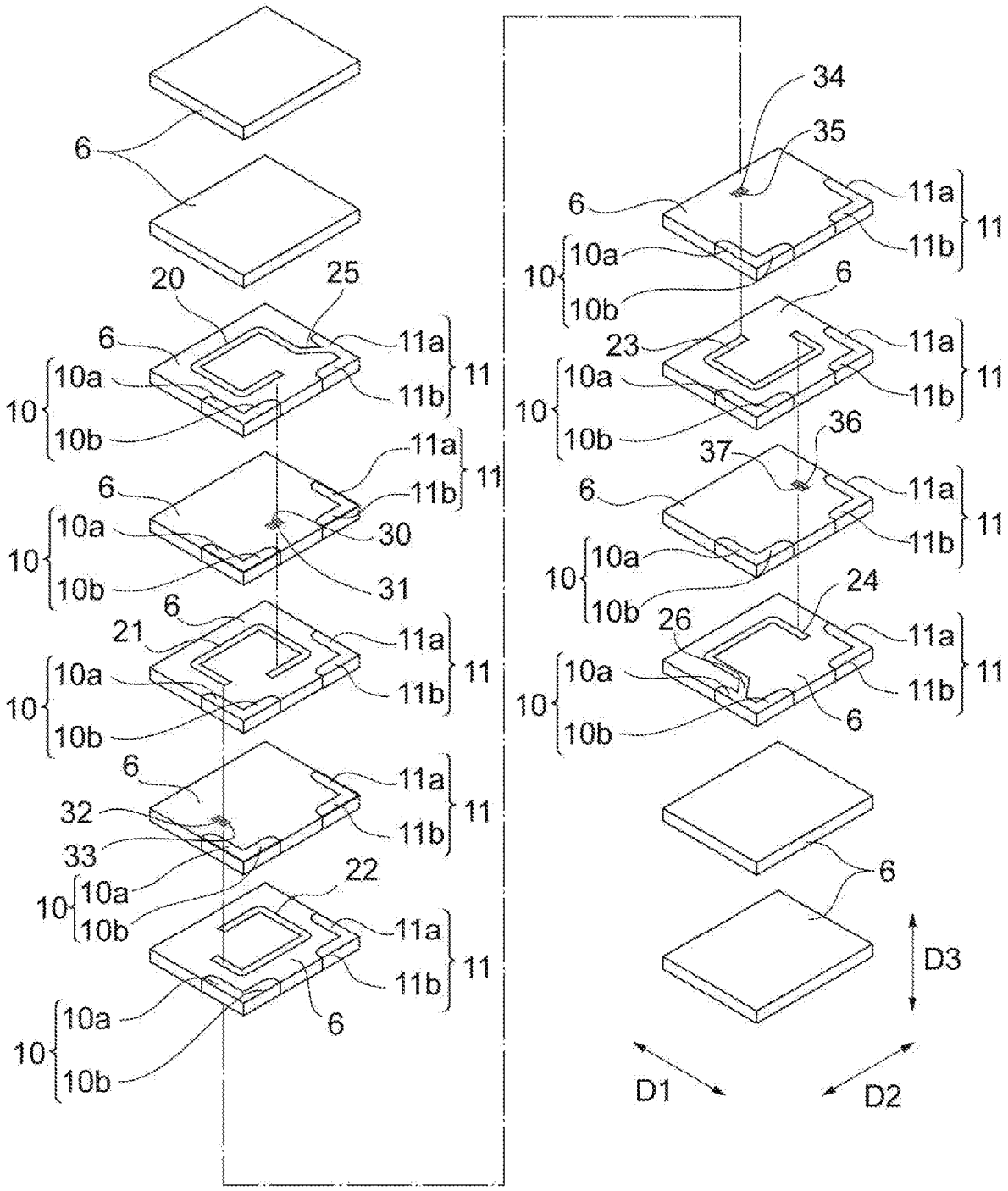
FIG. 2 is an exploded perspective view illustrating the configurations of an element, a coil conductor, and a connection conductor.

As illustrated in FIG. 2, the element 2 is configured by a plurality of insulator layers 6 being stacked in the third direction D3. The element 2 has the plurality of insulator layers 6 that are stacked. In the element 2, the direction in which the plurality of insulator layers 6 are stacked coincides with the third direction D3. In the actual element 2, the insulator layers 6 are integrated to such an extent that the boundary between the insulator layers 6 cannot be visually recognized. For example, a magnetic material constitutes each insulator layer 6. Examples of the magnetic material include a Ni—Cu—Zn-based ferrite material, a Ni—Cu—Zn—Mg-based ferrite material, and a Ni—Cu-based ferrite material. The magnetic material constituting each insulator layer 6 may contain a Fe alloy. A non-magnetic material may constitute each insulator layer 6. Examples of the non-magnetic material include a glass ceramic material and a dielectric material. In the present embodiment, a sintered body of a green sheet containing the magnetic material constitutes each insulator layer 6.

The terminal electrode 4 is disposed on the end surface 2*a* side of the element 2. The terminal electrode 5 is disposed on the end surface 2*b* side of the element 2. The pair of terminal electrodes 4 and 5 are separated from each other in the second direction D2. Each of the terminal electrodes 4 and 5 is embedded in the element 2. Each of the terminal electrodes 4 and 5 is disposed in a recessed portion formed in the element 2. The terminal electrode 4 is disposed over the end surface 2*a* and the main surface 2*d*. The terminal electrode 5 is disposed over the end surface 2*b* and the main surface 2*d*. In the present embodiment, the surface of the terminal electrode 4 is substantially flush with each of the end surface 2*a* and the main surface 2*d*. The surface of the terminal electrode 5 is substantially flush with each of the end surface 2*b* and the main surface 2*d*.

Each of the terminal electrodes 4 and 5 contains a conductive material. The conductive material contains, for example, Ag or Pd. Each of the terminal electrodes 4 and 5 is configured as a sintered body of conductive paste containing conductive material powder. Examples of the conductive material powder include Ag powder and Pd powder. A plating layer may be formed on the surface of each of the terminal electrodes 4 and 5. The plating layer is formed by, for example, electroplating or electroless plating. The plating layer contains, for example, Ni, Sn, or Au.

The terminal electrode 4 has an L shape when viewed from the third direction D3. The terminal electrode 4 has a plurality of electrode parts 4*a* and 4*b*. In the present embodiment, the terminal electrode 4 has a pair of electrode parts 4*a* and 4*b*. The electrode part 4*a* and the electrode part 4*b* are connected in the ridge line portion of the element 2 and are electrically connected to each other. In the present embodiment, the electrode part 4*a* and the electrode part 4*b* are integrally formed. The electrode part 4*a* extends along the first direction D1. The electrode part 4*a* has a rectangular shape when viewed from the second direction D2. The electrode part 4*b* extends along the second direction D2. The electrode part 4*b* has a rectangular shape when viewed from the first direction D1. Each of the electrode parts 4*a* and 4*b* extends along the third direction D3.

As illustrated in FIG. 2, the terminal electrode 4 is configured by a plurality of electrode layers 10 being stacked. In the present embodiment, the terminal electrode 4 has the plurality of electrode layers 10 that are stacked. In the present embodiment, the number of the electrode layers 10 is "9". Each electrode layer 10 is provided in a defect portion formed in the corresponding insulator layer 6. The electrode layer 10 is formed by the conductive paste that is positioned in the defect portion formed in the green sheet being fired. The green sheet and the conductive paste are fired at the same time. Accordingly, when the insulator layer 6 is obtained from the green sheet, the electrode layer 10 is obtained from the conductive paste. In the actual terminal electrode 4, the electrode layers 10 are integrated to such an extent that the boundary between the electrode layers 10 cannot be visually recognized. The defect portion formed in the green sheet allows the recessed portion of the fired element 2 where the terminal electrode 4 is disposed to be obtained.

Each electrode layer 10 has an L shape when viewed from the third direction D3. The electrode layer 10 has a plurality of layer parts 10*a* and 10*b*. In the present embodiment, the electrode layer 10 has a pair of layer parts 10*a* and 10*b*. The layer part 10*a* extends along the first direction D1. The layer part 10*b* extends along the second direction D2. The electrode part 4*a* is configured by the layer parts 10*a* of the electrode layers 10 being stacked. At the electrode part 4*a*, the layer parts 10*a* are integrated to such an extent that the boundary between the layer parts 10*a* cannot be visually recognized. The electrode part 4*b* is configured by the layer parts 10*b* of the electrode layers 10 being stacked. At the electrode part 4*b*, the layer parts 10*b* are integrated to such an extent that the boundary between the layer parts 10*b* cannot be visually recognized.

The terminal electrode 5 has an L shape when viewed from the third direction D3. The terminal electrode 5 has a plurality of electrode parts 5*a* and 5*b*. In the present embodiment, the terminal electrode 5 has a pair of electrode parts 5*a* and 5*b*. The electrode part 5*a* and the electrode part 5*b* are connected in the ridge line portion of the element 2 and are electrically connected to each other. In the present embodiment, the electrode part 5*a* and the electrode part 5*b* are integrally formed. The electrode part 5*a* extends along the first direction D1. The electrode part 5*a* has a rectangular shape when viewed from the second direction D2. The electrode part 5*b* extends along the second direction D2. The electrode part 5*b* has a rectangular shape when viewed from the first direction D1. Each of the electrode parts 5*a* and 5*b* extends along the third direction D3.

As illustrated in FIG. 2, the terminal electrode 5 is configured by a plurality of electrode layers 11 being stacked. In the present embodiment, the terminal electrode 5 has the plurality of electrode layers 11 that are stacked. In the present embodiment, the number of the electrode layers 11 is "9". Each electrode layer 11 is provided in a defect portion formed in the corresponding insulator layer 6. The electrode layer 11 is formed by the conductive paste that is positioned in the defect portion formed in the green sheet being fired. As described above, the green sheet and the conductive paste are fired at the same time. Accordingly, when the insulator layer 6 is obtained from the green sheet, the electrode layer 10 is obtained and the electrode layer 11 is obtained from the conductive paste. In the actual terminal electrode 5, the electrode layers 11 are integrated to such an extent that the boundary between the electrode layers 11 cannot be visually recognized. The defect portion formed in the green sheet allows the recessed portion of the fired element 2 where the terminal electrode 5 is disposed to be obtained.

Each electrode layer 11 has an L shape when viewed from the third direction D3. The electrode layer 11 has a plurality of layer parts 11*a* and 11*b*. In the present embodiment, the electrode layer 11 has a pair of layer parts 11*a* and 11*b*. The layer part 11*a* extends along the first direction D1. The layer part 11*b* extends along the second direction D2. The electrode part 5*a* is configured by the layer parts 11*a* of the electrode layers 11 being stacked. At the electrode part 5*a*, the layer parts 11*a* are integrated to such an extent that the boundary between the layer parts 11*a* cannot be visually recognized. The electrode part 5*b* is configured by the layer parts 11*b* of the electrode layers 11 being stacked. At the electrode part 5*b*, the layer parts 11*b* are integrated to such an extent that the boundary between the layer parts 11*b* cannot be visually recognized.

Figure 3:
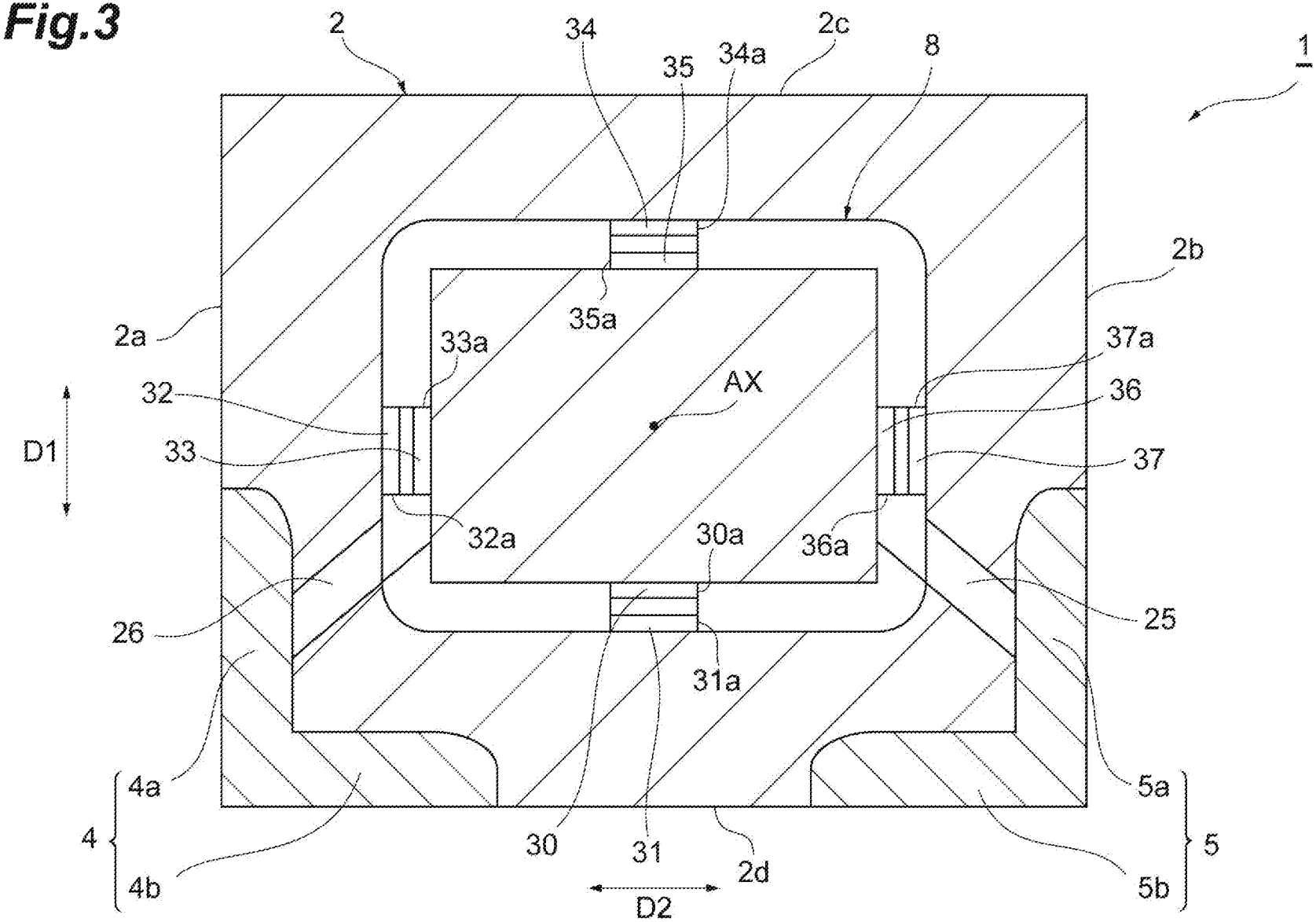
FIG. 3 is a diagram illustrating a terminal electrode, the coil conductor, and the connection conductor.

As illustrated in FIG. 3, the multilayer coil component 1 is provided with a coil 8 disposed in the element 2. A coil axis AX of the coil 8 extends along the third direction D3. The outer shape of the coil 8 has a substantially rectangular shape when viewed from the direction that is along the third direction D3.

As illustrated in FIG. 2, the coil 8 has a first coil conductor 20, a second coil conductor 21, a third coil conductor 22, a fourth coil conductor 23, and a fifth coil conductor 24. The first coil conductor 20, the second coil conductor 21, the third coil conductor 22, the fourth coil conductor 23, and the fifth coil conductor 24 are disposed along the third direction D3 in the order of the first coil conductor 20, the second coil conductor 21, the third coil conductor 22, the fourth coil conductor 23, and the fifth coil conductor 24. The first coil conductor 20, the second coil conductor 21, the third coil conductor 22, the fourth coil conductor 23, and the fifth coil conductor 24 substantially have a shape in which a part of a loop is interrupted and have one and the other ends. The first coil conductor 20, the second coil conductor 21, the third coil conductor 22, the fourth coil conductor 23, and the fifth coil conductor 24 have parts linearly extending along the first direction D1 and the second direction D2. The first coil conductor 20, the second coil conductor 21, the third coil conductor 22, the fourth coil conductor 23, and the fifth coil conductor 24 are formed so as to have a predetermined width.

The coil 8 has a first connection conductor 30, a second connection conductor 31, a third connection conductor 32, a fourth connection conductor 33, a fifth connection conductor 34, a sixth connection conductor 35, a seventh connection conductor 36, and an eighth connection conductor 37. The first connection conductor 30 and the second connection conductor 31, the third connection conductor 32 and the fourth connection conductor 33, the fifth connection conductor 34 and the sixth connection conductor 35, and the seventh connection conductor 36 and the eighth connection conductor 37 are disposed along the third direction D3 in the order of the first connection conductor 30 and the second connection conductor 31, the third connection conductor 32 and the fourth connection conductor 33, the fifth connection conductor 34 and the sixth connection conductor 35, and the seventh connection conductor 36 and the eighth connection conductor 37.

The first coil conductor 20 is positioned in the same layer as one electrode layer 10 and one electrode layer 11. The first coil conductor 20 is connected to the electrode layer 11 via a connecting conductor 25. The connecting conductor 25 is positioned in the same layer as the first coil conductor 20. One end of the first coil conductor 20 is connected to the connecting conductor 25. The connecting conductor 25 is connected to the layer part 11*a*. The connecting conductor 25 connects the first coil conductor 20 and the electrode layer 11 to each other. The connecting conductor 25 may be connected to the layer part 11*b*. The first coil conductor 20 is separated from the electrode layer 10 positioned in the same layer. In the present embodiment, the first coil conductor 20, the connecting conductor 25, and the electrode layer 11 are integrally formed.

The first connection conductor 30 and the second connection conductor 31 are disposed on the insulator layer 6 between the first coil conductor 20 and the second coil conductor 21. One electrode layer 10 and one electrode layer 11 are positioned on the insulator layer 6 where the first connection conductor 30 and the second connection conductor 31 are disposed. The first connection conductor 30 and the second connection conductor 31 are separated from the electrode layers 10 and 11 positioned in the same layer. The first connection conductor 30 and the second connection conductor 31 are connected to the other end of the first coil conductor 20 and are connected to one end of the second coil conductor 21. The first connection conductor 30 and the second connection conductor 31 connect the first coil conductor 20 and the second coil conductor 21 to each other.

As illustrated in FIG. 3, each of the first connection conductor 30 and the second connection conductor 31 has a rectangular shape. As viewed from the third direction D3, the length of an outer periphery 30*a* of the first connection conductor 30 is equivalent to the length of an outer periphery 31*a* of the second connection conductor 31. In other words, as viewed from the third direction D3, the cross-sectional area of the first connection conductor 30 (cross-sectional area in a plane along the first direction D1 and the second direction D2) is equivalent to the cross-sectional area of the second connection conductor 31. The equivalence does not necessarily mean equal values. The values may be equivalent even in a case where the values include a slight difference, a manufacturing error, or a measurement error within a preset range.

Each of the first connection conductor 30 and the second connection conductor 31 is disposed so as to have a longitudinal direction along the second direction D2. Each of the first connection conductor 30 and the second connection conductor 31 is disposed such that the longitudinal direction is along the extension direction of the first coil conductor 20 and the second coil conductor 21. The first connection conductor 30 and the second connection conductor 31 are disposed so as to overlap the other end of the first coil conductor 20 and one end of the second coil conductor 21 when viewed from the third direction D3. Specifically, the first connection conductor 30 and the second connection conductor 31 are spaced apart in the first direction D1. In other words, the first connection conductor 30 and the second connection conductor 31 are spaced apart only in the direction intersecting with the extension direction of the first coil conductor 20 and the second coil conductor 21 (second direction D2) at the position of the connection by the first connection conductor 30 and the second connection conductor 31. In other words, the first connection conductor 30 and the second connection conductor 31 are not disposed side by side in the direction along the extension direction of the first coil conductor 20 and the second coil conductor 21.

As illustrated in FIG. 2, the second coil conductor 21 is positioned in the same layer as one electrode layer 10 and one electrode layer 11. The second coil conductor 21 is separated from the electrode layers 10 and 11 positioned in the same layer. The first coil conductor 20 and the second coil conductor 21 are adjacent to each other in the third direction D3 with the insulator layer 6 interposed between the first coil conductor 20 and the second coil conductor 21. The other end of the first coil conductor 20 and one end of the second coil conductor 21 overlap each other when viewed from the third direction D3.

The third connection conductor 32 and the fourth connection conductor 33 are disposed on the insulator layer 6 between the second coil conductor 21 and the third coil conductor 22. One electrode layer 10 and one electrode layer 11 are positioned on the insulator layer 6 where the third connection conductor 32 and the fourth connection conductor 33 are disposed. The third connection conductor 32 and the fourth connection conductor 33 are separated from the electrode layers 10 and 11 positioned in the same layer. The third connection conductor 32 and the fourth connection conductor 33 are connected to the other end of the second coil conductor 21 and are connected to one end of the third coil conductor 22. The third connection conductor 32 and the fourth connection conductor 33 connect the second coil conductor 21 and the third coil conductor 22 to each other.

As illustrated in FIG. 3, each of the third connection conductor 32 and the fourth connection conductor 33 has a rectangular shape. As viewed from the third direction D3, the length of an outer periphery 32*a* of the third connection conductor 32 is equivalent to the length of an outer periphery 33*a* of the fourth connection conductor 33. In other words, as viewed from the third direction D3, the cross-sectional area of the third connection conductor 32 (cross-sectional area in the plane along the first direction D1 and the second direction D2) is equivalent to the cross-sectional area of the fourth connection conductor 33.

Each of the third connection conductor 32 and the fourth connection conductor 33 is disposed so as to have a longitudinal direction along the first direction D1. Each of the third connection conductor 32 and the fourth connection conductor 33 is disposed such that the longitudinal direction is along the extension direction of the second coil conductor 21 and the third coil conductor 22. The third connection conductor 32 and the fourth connection conductor 33 are disposed so as to overlap the other end of the second coil conductor 21 and one end of the third coil conductor 22 when viewed from the third direction D3. Specifically, the third connection conductor 32 and the fourth connection conductor 33 are spaced apart in the second direction D2. In other words, the third connection conductor 32 and the fourth connection conductor 33 are spaced apart only in the direction intersecting with the extension direction of the second coil conductor 21 and the third coil conductor 22 (first direction D1) at the position of the connection by the third connection conductor 32 and the fourth connection conductor 33.

As illustrated in FIG. 2, the third coil conductor 22 is positioned in the same layer as one electrode layer 10 and one electrode layer 11. The third coil conductor 22 is separated from the electrode layers 10 and 11 positioned in the same layer. The second coil conductor 21 and the third coil conductor 22 are adjacent to each other in the third direction D3 with the insulator layer 6 interposed between the second coil conductor 21 and the third coil conductor 22. The other end of the second coil conductor 21 and one end of the third coil conductor 22 overlap each other when viewed from the third direction D3.

The fifth connection conductor 34 and the sixth connection conductor 35 are disposed on the insulator layer 6 between the third coil conductor 22 and the fourth coil conductor 23. One electrode layer 10 and one electrode layer 11 are positioned on the insulator layer 6 where the fifth connection conductor 34 and the sixth connection conductor 35 are disposed. The fifth connection conductor 34 and the sixth connection conductor 35 are separated from the electrode layers 10 and 11 positioned in the same layer. The fifth connection conductor 34 and the sixth connection conductor 35 are connected to the other end of the third coil conductor 22 and are connected to one end of the fourth coil conductor 23. The fifth connection conductor 34 and the sixth connection conductor 35 connect the third coil conductor 22 and the fourth coil conductor 23 to each other.

As illustrated in FIG. 3, each of the fifth connection conductor 34 and the sixth connection conductor 35 has a rectangular shape. As viewed from the third direction D3, the length of an outer periphery 34*a* of the fifth connection conductor 34 is equivalent to the length of an outer periphery 35*a* of the sixth connection conductor 35. In other words, as viewed from the third direction D3, the cross-sectional area of the fifth connection conductor 34 (cross-sectional area in the plane along the first direction D1 and the second direction D2) is equivalent to the cross-sectional area of the sixth connection conductor 35.

Each of the fifth connection conductor 34 and the sixth connection conductor 35 is disposed so as to have a longitudinal direction along the second direction D2. Each of the fifth connection conductor 34 and the sixth connection conductor 35 is disposed such that the longitudinal direction is along the extension direction of the third coil conductor 22 and the fourth coil conductor 23. The fifth connection conductor 34 and the sixth connection conductor 35 are disposed so as to overlap the other end of the third coil conductor 22 and one end of the fourth coil conductor 23 when viewed from the third direction D3. Specifically, the fifth connection conductor 34 and the sixth connection conductor 35 are spaced apart in the first direction D1. In other words, the fifth connection conductor 34 and the sixth connection conductor 35 are spaced apart only in the direction intersecting with the extension direction of the third coil conductor 22 and the fourth coil conductor 23 (second direction D2) at the position of the connection by the fifth connection conductor 34 and the sixth connection conductor 35.

As illustrated in FIG. 2, the fourth coil conductor 23 is positioned in the same layer as one electrode layer 10 and one electrode layer 11. The fourth coil conductor 23 is separated from the electrode layers 10 and 11 positioned in the same layer. The third coil conductor 22 and the fourth coil conductor 23 are adjacent to each other in the third direction D3 with the insulator layer 6 interposed between the third coil conductor 22 and the fourth coil conductor 23. The other end of the third coil conductor 22 and one end of the fourth coil conductor 23 overlap each other when viewed from the third direction D3.

The seventh connection conductor 36 and the eighth connection conductor 37 are disposed on the insulator layer 6 between the fourth coil conductor 23 and the fifth coil conductor 24. One electrode layer 10 and one electrode layer 11 are positioned on the insulator layer 6 where the seventh connection conductor 36 and the eighth connection conductor 37 are disposed. The seventh connection conductor 36 and the eighth connection conductor 37 are separated from the electrode layers 10 and 11 positioned in the same layer. The seventh connection conductor 36 and the eighth connection conductor 37 are connected to the other end of the fourth coil conductor 23 and are connected to one end of the fifth coil conductor 24. The seventh connection conductor 36 and the eighth connection conductor 37 connect the fourth coil conductor 23 and the fifth coil conductor 24 to each other.

As illustrated in FIG. 3, each of the seventh connection conductor 36 and the eighth connection conductor 37 has a rectangular shape. As viewed from the third direction D3, the length of an outer periphery 36*a* of the seventh connection conductor 36 is equivalent to the length of an outer periphery 37*a* of the eighth connection conductor 37. In other words, as viewed from the third direction D3, the cross-sectional area of the seventh connection conductor 36 (cross-sectional area in the plane along the first direction D1 and the second direction D2) is equivalent to the cross-sectional area of the eighth connection conductor 37.

Each of the seventh connection conductor 36 and the eighth connection conductor 37 is disposed so as to have a longitudinal direction along the first direction D1. Each of the seventh connection conductor 36 and the eighth connection conductor 37 is disposed such that the longitudinal direction is along the extension direction of the fourth coil conductor 23 and the fifth coil conductor 24. The seventh connection conductor 36 and the eighth connection conductor 37 are disposed so as to overlap the other end of the fourth coil conductor 23 and one end of the fifth coil conductor 24 when viewed from the third direction D3. Specifically, the seventh connection conductor 36 and the eighth connection conductor 37 are spaced apart in the second direction D2. In other words, the seventh connection conductor 36 and the eighth connection conductor 37 are spaced apart only in the direction intersecting with the extension direction of the fourth coil conductor 23 and the fifth coil conductor 24 (first direction D1) at the position of the connection by the seventh connection conductor 36 and the eighth connection conductor 37.

The fifth coil conductor 24 is positioned in the same layer as one electrode layer 10 and one electrode layer 11. The fifth coil conductor 24 is connected to the electrode layer 10 via a connecting conductor 26. The connecting conductor 26 is positioned in the same layer as the fifth coil conductor 24. The other end of the fifth coil conductor 24 is connected to the connecting conductor 26. The connecting conductor 26 is connected to the layer part 10*a*. The connecting conductor 26 connects the fifth coil conductor 24 and the electrode layer 10 to each other. The connecting conductor 26 may be connected to the layer part 10*b*. The fifth coil conductor 24 is separated from the electrode layer 11 positioned in the same layer. In the present embodiment, the fifth coil conductor 24, the connecting conductor 26, and the electrode layer 10 are integrally formed.

The first coil conductor 20, the second coil conductor 21, the third coil conductor 22, the fourth coil conductor 23, and the fifth coil conductor 24 are electrically connected through the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37. The first coil conductor 20, the second coil conductor 21, the third coil conductor 22, the fourth coil conductor 23, and the fifth coil conductor 24 constitute the coil 8. The coil 8 is electrically connected to the terminal electrode 5 through the connecting conductor 25. The coil 8 is electrically connected to the terminal electrode 4 through the connecting conductor 26.

The first coil conductor 20, the second coil conductor 21, the third coil conductor 22, the fourth coil conductor 23, and the fifth coil conductor 24, the connecting conductors 25 and 26, and the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 contain a conductive material. The conductive material contains Ag or Pd. The first coil conductor 20, the second coil conductor 21, the third coil conductor 22, the fourth coil conductor 23, and the fifth coil conductor 24, the connecting conductors 25 and 26, and the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 are configured as sintered bodies of conductive paste containing conductive material powder. Examples of the conductive material powder include Ag powder and Pd powder.

In the present embodiment, the first coil conductor 20, the second coil conductor 21, the third coil conductor 22, the fourth coil conductor 23, and the fifth coil conductor 24, the connecting conductors 25 and 26, and the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 contain the same conductive material as each of the terminal electrodes 4 and 5. The first coil conductor 20, the second coil conductor 21, the third coil conductor 22, the fourth coil conductor 23, and the fifth coil conductor 24, the connecting conductors 25 and 26, and the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 may contain a conductive material different from the conductive material of each of the terminal electrodes 4 and 5.

The first coil conductor 20, the second coil conductor 21, the third coil conductor 22, the fourth coil conductor 23, and the fifth coil conductor 24, the connecting conductors 25 and 26, and the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 are provided in the defect portion formed in the corresponding insulator layer 6. The first coil conductor 20, the second coil conductor 21, the third coil conductor 22, the fourth coil conductor 23, and the fifth coil conductor 24, the connecting conductors 25 and 26, and the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 are formed by the conductive paste that is positioned in the defect portion formed in the green sheet being fired. As described above, the green sheet and the conductive paste are fired at the same time. Accordingly, when the insulator layer 6 is obtained from the green sheet, each of the first coil conductor 20, the second coil conductor 21, the third coil conductor 22, the fourth coil conductor 23, and the fifth coil conductor 24, the connecting conductors 25 and 26, and the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 is obtained from the conductive paste.

The defect portion formed in the green sheet is formed by, for example, the following process. First, the green sheet is formed by element paste that contains a photosensitive material and the constituent material of the insulator layer 6 being applied onto a base material. The base material is, for example, a PET film. The photosensitive material contained in the element paste may be either a negative-type photosensitive material or a positive-type photosensitive material and a known photosensitive material can be used as the photosensitive material contained in the element paste. Next, the green sheet is exposed and developed by a photolithography method and by means of a mask corresponding to the defect portion, which results in defect portion formation in the green sheet on the base material. The green sheet where the defect portion is formed is an element pattern.

The electrode layers 10 and 11, the first coil conductor 20, the second coil conductor 21, the third coil conductor 22, the fourth coil conductor 23, and the fifth coil conductor 24, the connecting conductors 25 and 26, and the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 are formed by, for example, the following process.

First, a conductor material layer is formed by conductive paste that contains a photosensitive material being applied onto a base material. The photosensitive material contained in the conductive paste may be either a negative-type photosensitive material or a positive-type photosensitive material and a known photosensitive material can be used as the photosensitive material contained in the conductive paste. Next, the conductor material layer is exposed and developed by a photolithography method and by means of a mask corresponding to the defect portion, and then a conductor pattern corresponding to the shape of the defect portion is formed on the base material.

The multilayer coil component 1 is obtained by, for example, the following process following the process described above. A sheet in which the element pattern and the conductor pattern are in the same layer is prepared by the conductor pattern being combined with the defect portion of the element pattern. A predetermined number of the sheets are prepared, a laminate is obtained by the sheets being stacked, the laminate is heat-treated, and then a plurality of green chips are obtained from the laminate. In this process, the green laminate is cut into chips by means of a cutting machine or the like. As a result, the plurality of green chips having a predetermined size can be obtained. Next, the green chip is fired. The multilayer coil component 1 is obtained as a result of the firing. The terminal electrodes 4 and 5 and the coil 8 are integrally formed in the multilayer coil component 1.

As described above, in the multilayer coil component 1 according to the present embodiment, the first connection conductor 30 and the second connection conductor 31 are spaced apart only in the direction intersecting with the extension direction of the first coil conductor 20 and the second coil conductor 21 at the position of the connection by the first connection conductor 30 and the second connection conductor 31 when viewed from the third direction D3. In other words, the first connection conductor 30 and the second connection conductor 31 are spaced apart in a direction that is not along the extension direction of the first coil conductor 20 and the second coil conductor 21. As a result, when a current flows through the coil 8 in the multilayer coil component 1, the current flows evenly (in a distributed manner) with respect to the first connection conductor 30 and the second connection conductor 31. Accordingly, in the multilayer coil component 1, it is possible to avoid resistance becoming high and the current flow becoming difficult due to current concentration on one connection conductor. Therefore, degradation of characteristics can be suppressed in the multilayer coil component 1.

In the multilayer coil component 1 according to the present embodiment, each of the first connection conductor 30 and the second connection conductor 31 has a shape along the first coil conductor 20 and the second coil conductor 21 when viewed from the third direction D3. In this configuration, the surface areas of the first connection conductor 30 and the second connection conductor 31 can be ensured. Accordingly, an increase in the resistance of the first connection conductor 30 and the second connection conductor 31 can be suppressed, even in the case of current concentration on the surfaces of the first connection conductor 30 and the second connection conductor 31 attributable to a skin effect, since the surface areas are large.

In the multilayer coil component 1, the third connection conductor 32 and the fourth connection conductor 33, the fifth connection conductor 34 and the sixth connection conductor 35, and the seventh connection conductor 36 and the eighth connection conductor 37 have the same configuration as the first connection conductor 30 and the second connection conductor 31. Accordingly, in the multilayer coil component 1, the same action and effect as in the first connection conductor 30 and the second connection conductor 31 can be obtained in the third connection conductor 32 and the fourth connection conductor 33, the fifth connection conductor 34 and the sixth connection conductor 35, and the seventh connection conductor 36 and the eighth connection conductor 37.

Although an embodiment of the present invention has been described above, the present invention is not necessarily limited to the embodiment described above and various modifications can be made within the scope of the present invention.

In the embodiment described above, a form in which the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 have a rectangular shape has been described as an example. However, the connection conductors are not limited to the shape described above.

Figure 4B:
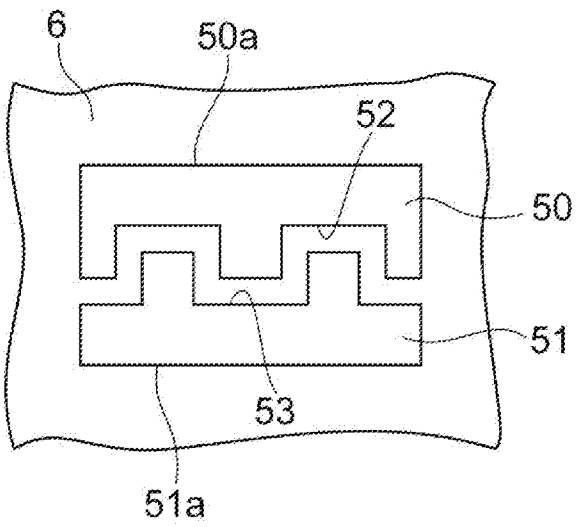
FIG. 4B is a diagram illustrating a connection conductor of a multilayer coil component according to another embodiment.
Figure 4A:
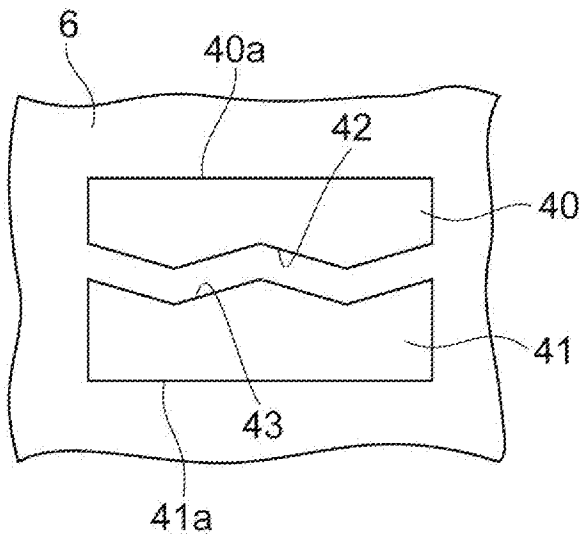
FIG. 4A is a diagram illustrating a connection conductor of a multilayer coil component according to another embodiment.

As illustrated in FIG. 4A, an irregularity 42 is formed at a part of an outer periphery 40*a* of a connection conductor 40. Specifically, when viewed from the third direction D3, the irregularity 42 is formed at a part that faces a connection conductor 41 disposed so as to face the irregularity 42. The irregularity 42 has a triangular shape. An irregularity 43 is formed at a part of an outer periphery 41*a* of the connection conductor 41. Specifically, when viewed from the third direction D3, the irregularity 43 is formed at a part that faces the connection conductor 40 disposed so as to face the irregularity 43. The irregularity 43 has a triangular shape. When viewed from the third direction D3, the projecting portion of the other connection conductor 41 is disposed in the recessed portion of one connection conductor 40 in the pair of connection conductors 40 and 41 disposed so as to face each other.

As illustrated in FIG. 4B, an irregularity 52 is formed at a part of an outer periphery 50*a* of a connection conductor 50. Specifically, when viewed from the third direction D3, the irregularity 52 is formed at a part that faces a connection conductor 51 disposed so as to face the irregularity 52. The irregularity 52 has a triangular shape. An irregularity 53 is formed at a part of an outer periphery 51*a* of the connection conductor 51. Specifically, when viewed from the third direction D3, the irregularity 53 is formed at a part that faces the connection conductor 50 disposed so as to face the irregularity 53. The irregularity 53 has a triangular shape. When viewed from the third direction D3, the projecting portion of the other connection conductor 51 is disposed in the recessed portion of one connection conductor 50 in the pair of connection conductors 50 and 51 disposed so as to face each other.

In the connection conductors 40, 41, 50, and 51, the irregularities 42, 43, 52, and 53 are formed on the outer peripheries 40*a*, 41*a*, 50*a*, and 51*a*. In this configuration, the surface areas of the connection conductors 40, 41, 50, and 51 can be increased. As a result, the surface areas of the connection conductors 40, 41, 50, and 51 through which a current is capable of flowing in the skin effect are increased, and thus an increase in the resistance of the connection conductors 40, 41, 50, and 51 can be further suppressed. In addition, in the connection conductors 40, 41, 50, and 51, the projecting portions of the irregularities 43 and 53 of the other connection conductors 41 and 51 are disposed in the recessed portions of the irregularities 42 and 52 of one connection conductors 40 and 50. In this configuration, the contact area between the coil conductor and the connection conductors 40, 41, 50, and 51 can be ensured (to the maximum). Accordingly, a current is capable of easily flowing through the coil 8.

In the embodiment described above, a form in which the coil 8 has the first coil conductor 20, the second coil conductor 21, the third coil conductor 22, the fourth coil conductor 23, and the fifth coil conductor 24, the connecting conductors 25 and 26, and the first connection conductor 30, the second connection conductor 31, the third connection conductor 32, the fourth connection conductor 33, the fifth connection conductor 34, the sixth connection conductor 35, the seventh connection conductor 36, and the eighth connection conductor 37 has been described as an example. However, the number of conductors constituting the coil 8 is not limited to the value described above.

In the embodiment described above, a form in which one coil conductor and another coil conductor are connected by two connection conductors has been described as an example. However, one coil conductor and another coil conductor may be connected by three or more connection conductors.

In the embodiment described above, a form in which the coil axis AX of the coil 8 extends along the third direction D3 has been described as an example. However, the coil axis AX of the coil 8 may extend along the first direction D1 In this case, the direction in which the plurality of insulator layers 6 are stacked coincides with the first direction D1.

In the embodiment described above, a form in which the terminal electrode 4 has the electrode part 4*a* and the electrode part 4*b* has been described as an example. However, the terminal electrode 4 may have only the electrode part 4*a* and may have only the electrode part 4*b*. Likewise, the terminal electrode 5 may have only the electrode part 5*a* and may have only the electrode part 5*b*. Each of the terminal electrodes 4 and 5 may not be disposed in the recessed portion formed in the element 2. In this case, each of the terminal electrodes 4 and 5 is disposed on the surface of an element where no recessed portion is formed.

What is claimed is:

1. A multilayer coil component comprising:

an element having a plurality of stacked insulator layers; and a coil in the element, wherein the coil has a plurality of coil conductors and a plurality of connection conductors, each of the plurality of connection conductors connects one of the plurality of coil conductors and another of the plurality of coil conductors, and the plurality of the connection conductors (i) are spaced apart only in a first direction intersecting with an extension direction of the plurality of coil conductors at a connection of the plurality of connection conductors when viewed from a second direction in which the plurality of insulator layers are stacked and (ii) overlap when viewed in the first direction.

2. The multilayer coil component according to claim 1, wherein the each of the plurality of connection conductors has a same shape along the plurality of coil conductors when viewed from the direction in which the plurality of insulator layers are stacked.

3. The multilayer coil component according to claim 1, wherein a length of an outer periphery of the each of the plurality of connection conductors is equivalent when viewed from the direction in which the plurality of insulator layers are stacked.

4. The multilayer coil component according to claim 1, wherein an irregularity is formed at least in part on each outer periphery of each of the plurality of connection conductors when viewed from the direction in which the plurality of insulator layers are stacked.

5. The multilayer coil component according to claim 4, wherein a projecting portion of the irregularity of a first of the plurality of connection conductors is disposed inmates with a recessed portion of the irregularity of a second of the plurality of connection conductors when viewed from the direction in which the plurality of insulator layers are stacked.

* * * * *